United States Patent [19]

Pinnekamp

[11] Patent Number: 4,591,680

[45] Date of Patent: May 27, 1986

[54] ISOLATING SWITCH

[75] Inventor: Friedrich Pinnekamp, Siggenthal-Station, Switzerland

[73] Assignee: BBC Brown, Boveri & Co., Ltd., Switzerland

[21] Appl. No.: 664,343

[22] Filed: Oct. 24, 1984

[30] Foreign Application Priority Data

Nov. 11, 1983 [CH] Switzerland ..... 6085/83

[51] Int. Cl.[4] ..... H01H 33/12

[52] U.S. Cl. ..... 200/146 R; 200/144 R; 200/148 R; 200/252

[58] Field of Search ..... 200/146 R, 144 AP, 148 R, 200/252, 150 M

[56] References Cited

U.S. PATENT DOCUMENTS

| | | | |
|---|---|---|---|
| 896,210 | 8/1908 | James | 200/252 |
| 3,278,711 | 10/1966 | Thuries et al. | 200/252 |
| 4,338,500 | 7/1982 | Pham Van et al. | 200/144 AP |
| 4,427,858 | 1/1984 | Fehr et al. | 200/146 R |
| 4,499,351 | 2/1985 | Koppl | 200/150 M |

*Primary Examiner*—Robert S. Macon

*Attorney, Agent, or Firm*—Ostrolenk, Faber, Gerb & Soffen

[57] ABSTRACT

In this isolating switch, which is suitable for electrically isolating and connecting components of gas-insulated encapsulated switching stations under, at the most, low load conditions, the fixed contact member (1) is provided with a central trailing contact (2) which ends in a contact member (7). It is coaxially surrounded by a circle of rated-current fingers (3*a–h*) and a fixed contact shielding electrode (15). The central contact rod (5) of the movable contact member (4) is coaxially surrounded at a distance by a shielding electrode (6) which is also movable.

In order to prevent undesirable flash-overs, in particular flash-overs at the encapsulation, the rated-current fingers (3*a–h*) are in contact with the contact rod (5) in the area surrounded by the shielding electrode (6) which is also movable. They are mounted to be rotatable and have forces applied to them which press their end members (14*a–h*) radially inward. The contact member (7) is constructed as a shield-like plate having a front face (21) which is domed forward towards the movable contact arrangement (4). When the trailing contact (2) is pushed back, the rated-current fingers (3*a–h*), which are located behind the front face (21) when the trailing contact (2) is pushed forward, project through openings (22*a–h*) in the contact member. The contact rod (5) and, on its inside, the shielding electrode (6) which moves along with the former are provided with circumferential grooves (19,20).

5 Claims, 2 Drawing Figures

ISOLATING SWITCH

The invention relates to an isolating switch according to the precharacterising clause of claim 1.

Such isolating switches are used in switching stations for electrically connecting and isolating system components under, at the most, low load conditions; they are mostly connected in series with on-load switches.

An isolating switch according to the precharacterising clause of claim 1 is known (German Offenlegungsschrift No. 3,140,112) in which the rated-current fingers are in contact with the movable contact member on the outside of the shielding electrode, which moves with it and surrounds the contact rod, in the on-position. As a result, rough areas can be produced at that location which, when using the isolating switch in a gas-insulated encapsulated system, reduce the dielectric strength between the movable contact arrangement and the encapsulation.

The invention has the object of improving generic isolatin switches with respect to preventing flash-overs and the formation of arcs at places where this could have damaging consequences, especially between the contact arrangements on the one hand and the encapsulation on the other hand, where these switches are used in gas-insulated encapsulated systems.

This object is achieved by the invention as characterised in the claims.

The advantages achieved by the invention lie primarily in the fact that the movable contact member is contacted by the end members of the rated-current fingers in an area which is shielded on the outside and is loaded comparatively lightly by a field so that surface roughening by contact abrasion cannot lead to a reduction of the dielectric strength between the movable contact member and the encapsulation.

Figure 1:
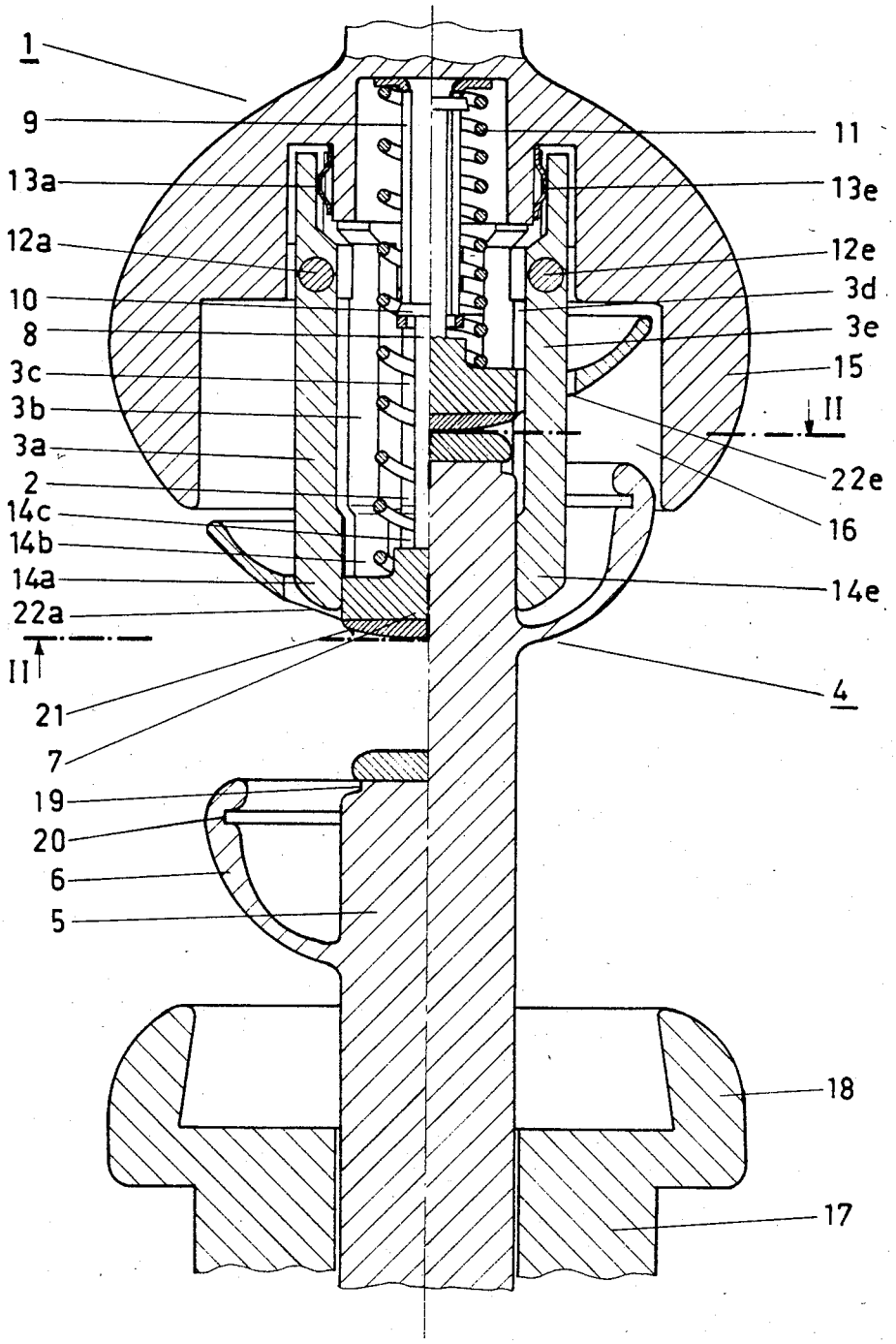
Figure 2:
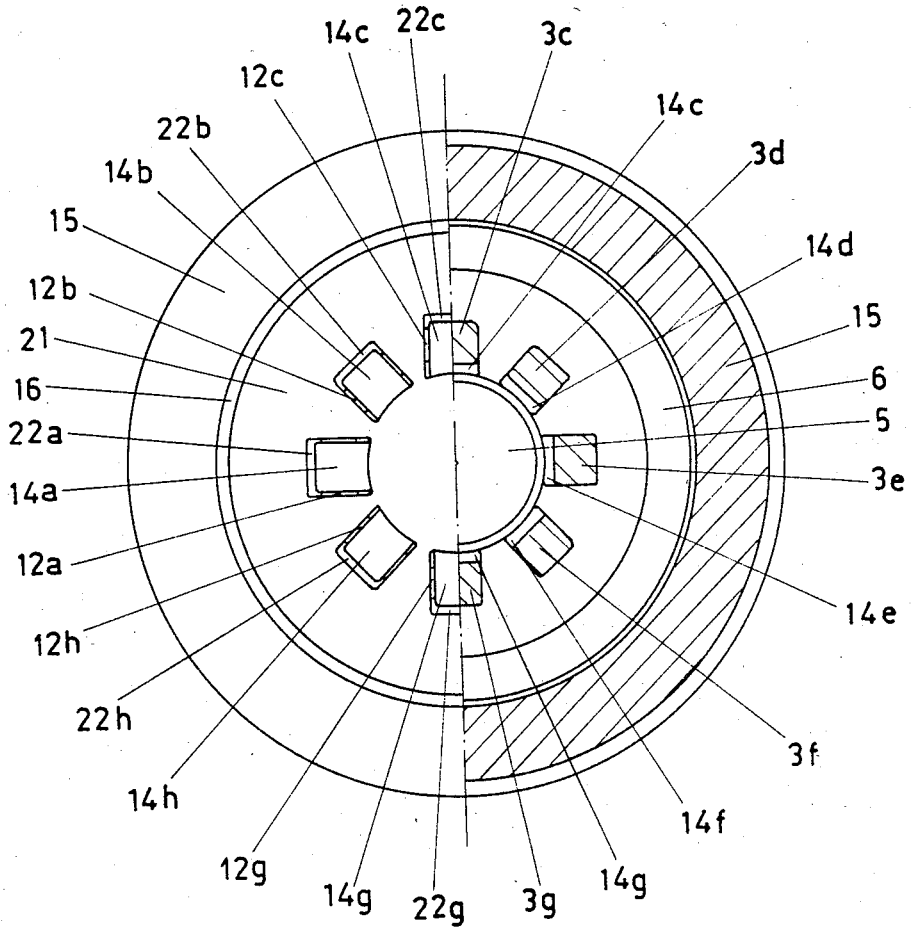

In the text which follows, the invention is explained in greater detail with the aid of drawings which represent only one possible embodiment and in which:

FIG. 1 shows an axial longitudinal section through an isolating switch according to the invention, and FIG. 2 shows a cross-section along II—II in FIG. 1, the left-hand side showing a top view of the fixed contact member and the right-hand side essentially showing a top view of the movable contact member.

The Figures show an isolating switch which, in its fundamental construction, has a fixed contact member 1 having a centrally arranged trailing contact 2 and a ring, surrounding the latter coaxially, of rated-current fingers 3*a–h* and a movable contact member 4 having a contact rod 5 and a shielding electrode 6 which is attached to the latter and moves with it and which coaxially at a distance surrounds an area of the contact rod 5 beginning directly behind the end of the latter facing the fixed contact member 1.

The trailing contact 2 consists of a contact member 7 and a plunger 8 (not shown in section) which can be displaced in a tube 9, which is longitudinally slotted twice up to near its front end, and has at the end opposite to the contact member 7 a locking bar 10 the projecting parts of which extend through the slots in the tube 9. This bar is loaded by a spiral spring 11 having a force acting in the off-direction. The rated-current fingers 3*a–h* are suspended to be rotatable at bolts 12*a–h* which are simultaneously used for conducting current. Leaf springs 13*a–h* exert forces on the rated-current contact fingers 3*a–h*, which forces press the end members 14*a–h* of the latter, contacting the movable contact arrangement 4 in the on-position, radially inwards.

The fixed contact member 1 is surrounded by a fixed contact shielding electrode 15 having an opening 16 towards the movable contact member 4 into which the latter projects in the on-position.

The contact rod 5 is carried in a holder 17 having a fixed shielding electrode 18.

According to the invention, the rated-current fingers 3*a–h* are arranged in such a manner that, in the on-position, their end members 14*a–h*, contacting the movable contact member 4, are pushed between the contact rod 5 and the shielding electrode 6 moving with it. They rest against the side of the contact rod 5. The contact rod 5 has directly behind its end which faces the fixed contact member 1 and which is provided with a cap, for example of tungsten-copper, which is resistant to burning, a peripheral groove 19 and the shielding electrode 6, moving with the contact rod 5, is also provided at its inside facing the contact rod 5, in the vicinity of the edge facing the fixed contact member 1, with a peripheral groove 20. On the outside, the shielding electrode 6 moving with the contact rod 5 can be coated, for example anodized, with an insulating layer.

The contact member 7 of the trailing contact 2 has the form of a shield-like plate having a front face 21 which is domed forward towards the movable contact member 4 and is constructed to be resistant to burning in the centre, and essentially covers the opening 16 of the fixed contact shielding electrode 15 in the off-position. The contact member 7 has openings 22*a–h* through which, in the on-position, the rated-current fingers 3*a–h* project when the trailing contact 2 is pushed back by the contact rod 5. If the trailing contact 2 is fully pushed forward as is the case in the off-position, the rated-forward current fingers 3*a–h* are wholly located behind the front face 21.

The isolating switch is arranged in a gas-filled space and coaxially surrounded by a cylindrical earthed metal encapsulation (not shown).

In the off-position, an essentially axially aligned electric field is located between the fixed contact member 1 and the movable contact member 4. As a result of the action of the shielding electrode 6, moving with 5, and due to the doming-forward of the front face 21, the field is strongest in the switch axis, that is to say between the contact rod 5 and the centre of the front face 21. As the movable contact member 4 approaches the fixed contact member 1 during the switching-on process, an electric flashover will therefore form at this location. The construction of the contact member 7 as a shield-like plate which essentially covers the opening 16 of the fixed contact shielding 15, has the effect that the arc root on the side of the fixed contact member 1 will not form on sensitive parts of the latter and that, in particular, the rated-current fingers 3*a–h* located behind the front face 21 are well protected. Due to the formation of a flash-over, the potentials of the fixed contact member 1 and of the movable contact member 4 approach each other and an essentially radially aligned field forms between the contact members, on the one hand, and the earthed encapsulation, on the other hand. The radial field is prevented, again by the shape of the contact member 7 and by the shielding electrode 6, moving with 5, from penetrating into the area of the switch axis and pulling the discharge from there into the edge region of the contact members, that is to say into the vicinity of the encapsulation which could easily lead to an encapsulation flash-over.

In this phase, even areas roughened by contact abrasion can easily become starting points for encapsulation flash-overs. This danger does not exist in the switch according to the invention because the area of the movable contact member 4 which may have been roughened by friction against the rated-current fingers 3*a–h* is shielded towards the outside, that is to say towards the encapsulation, by the shielding electrode 6 moving with 5. The shielding electrode 6 also prevents stronger penetration of the axial field, predominating before the formation of a flash-over, into this region.

The areas under the highest field loading are located at the end, facing the fixed contact member 1, of the contact rod 5 and at the edge, also facing the former, of the shielding electrode 6 moving with 5. The grooves 19 and 20 provided at these paths catch particles generated by contact abrasion and keep them away from the above-mentioned regions.

During the switching-off process, the conditions are analogous to those existing during the switching-on process, with a reversal in the time sequence. As the contact rod 5 separates from the contact member 7, an arc is drawn in the switch axis. During this process, the arc is prevented by the measures described above, in a manner already explained, from being drawn away from the switch axis by the then predominating radial field, and the axial field forming after extinction of the arc is prevented from leading to reignitions at places where this could cause damage.

1. Isolating switch containing an essentially rotationally symmetric fixed contact member (1) having a centrally arranged trailing contact (2) ending in a contact member (7), and a ring, coaxially surrounding the fixed contact member (1), of rated-current fingers (3*a–h*; a likewise essentially rotationally symmetric movable contact member (4) having a centrally arranged contact rod (5) and a shielding electrode (6) both of which are movable along with said movable contact member (4), said shielding electrode (6) coaxially surrounds at a distance at least the region of said contact rod (5) which is located directly behind the end of said movable contact member (4) facing said fixed contact member (1), characterised in that said rated-current fingers (3*a–h*) are arranged and constructed in such a manner that their end members (14*a–h*) contacting said movable contact member (4) are positioned between said contact rod (5) and said shielding electrode (6) during the switching-on process.

2. Isolating switch according to claim 1, wherein said contact rod (5) has, directly behind its end facing said fixed contact member (1), a peripheral groove (19).

3. Isolating switch according to claim 2, wherein said sheilding electrode (6) movable with said contact rod (5) has, at its inside facing said contact rod (5), a peripheral groove (20).

4. Isolating switch according to claim 1 wherein said fixed contact member (1) surrounded by a fixed contact shielding electrode (15) having an opening (16) towards said movable contact member (4) into which opening said movable contact member (4) projects in the on-position; said contact member (7) of said trailing contact (2) constructed as a shield-like plate having a front face (21) which is domed forward towards said movable contact member (4) and which, in the off-position, essentially covers the opening (16) of said fixed contact shielding electrode (15); said front face (21) having openings (22*a–h*) through which, in the on-position, with said trailing contact (2) pushed back, said rated-current contact fingers (3*a–h*) project whereas, in the off-position, the said rated-current fingers (3*a–h*) are located behind the domedforward front face (21).

5. Isolating switch according to claim 4, characterised in that said rated-current fingers (3*a–h*) are mounted to be rotatable and are loaded by forces by which their said end members (14*a–h*) are pressed radially inwards.

* * * * *